United States Patent [19]

Garland

[11] 4,027,496

[45] June 7, 1977

[54] DUAL LIQUID DELIVERY AND SEPARATION APPARATUS AND PROCESS

[75] Inventor: Milton W. Garland, Waynesboro, Pa.

[73] Assignee: Frick Company, Waynesboro, Pa.

[22] Filed: June 22, 1976

[21] Appl. No.: 698,641

[52] U.S. Cl. ..... 62/117; 62/174; 62/196 R; 62/504

[51] Int. Cl.² ..... F25B 5/00; F25B 41/00; F25B 39/02

[58] Field of Search ..... 62/117, 196 R, 504, 62/525, 174

[56] References Cited

UNITED STATES PATENTS

| | | | |
|---|---|---|---|
| 2,952,137 | 9/1960 | Watkins | 62/174 |
| 3,352,124 | 11/1967 | Watkins | 62/504 |
| 3,827,249 | 8/1974 | Garland et al. | 62/174 |
| 3,848,425 | 11/1974 | Watkins | 62/174 |

*Primary Examiner*—Lloyd L. King
*Attorney, Agent, or Firm*—A. Yates Dowell, Jr.

[57] ABSTRACT

A refrigerant delivery and separation apparatus and a process for delivering refrigerant at evaporator temperature to an evaporator at a predetermined pressure which is less than the pressure at the receiver, and simultaneously separating refrigerant liquid and vapor which is discharged from the evaporator. The apparatus includes a pair of tanks connected by time operated control members to conventional refrigeration equipment so that one tank is pumping liquid refrigerant to an evaporator at a predetermined pressure while the other tank is separating liquid and vapor refrigerant substantially at evaporator pressure.

9 Claims, 4 Drawing Figures

DUAL LIQUID DELIVERY AND SEPARATION APPARATUS AND PROCESS

BACKGROUND OF THE INVENTION

1. Field of the Invention

This invention relates generally to refrigerating equipment and processes of various kinds and relates particularly to a dual refrigerant delivery and separation apparatus as well as a process for delivering refrigerant to an evaporator and simultaneously separating liquid and vapor refrigerant discharged from the evaporator.

2. Description of the Prior Art

Heretofore many efforts have been made to circulate pressurized refrigerant through an evaporator by using a pair of alternately pressurizable pumping tanks so that high pressure is introduced into one tank to deliver refrigerant to the evaporator, while the other tank is not pressurized and is being charged with liquid refrigerant. Most of these prior art structures have included a relatively large accumulator-separator for receiving refrigerant liquid and vapor from the evaporator and separating the same so that the vapor can be returned to a compressor while the liquid refrigerant is returned to the pumping tanks. Some examples of this type of structure are the U.S. Pat. to Garland No. 3,827,249 and the U.S. Pat. Nos. to Watkins 2,952,137 and 3,848,425.

Also some prior art structures have been provided with a plurality of pumping tanks which have not required an accumulator-separator. However, these prior art structures either have not utilized the tanks for separating refrigerant liquid and vapor on the suction side of the evaporator or have required high pressure for pumping liquid refrigerant to the inlet side of the evaporator. Some examples of this type of structure are the U.S. Pat. Nos. to Watkins 2,931,191 and 3,352,124, and Mauer 3,248,895.

SUMMARY OF THE INVENTION

The present invention is embodied in an apparatus for pumping liquid refrigerant which is approximately at evaporator temperature to an evaporator at a controlled pressure and simultaneously separating liquid refrigerant from vapor substantially at evaporator pressure. The apparatus includes a pair of tanks, one of which is pumping liquid refrigerant to the evaporator at a controlled pressure which is less than condenser and receiver pressure but greater than evaporator pressure, while the other tank is receiving a charge of liquid refrigerant and is separating refrigerant vapor from the liquid and returning the vapor to a compressor.

The invention also is embodied in a process of supplying liquid refrigerant to an evaporator at evaporator temperature and at a controlled pressure and simultaneously separating refrigerant liquid and vapor which are at evaporator pressure.

It is an object of the invention to provide a dual liquid delivery and separation apparatus having a pair of pumping tanks which alternately are pressurized substantially to a predetermined pressure, which is less than condenser and receiver pressure, for delivering liquid refrigerant to an evaporator and such tanks alternately are connected to receive refrigerant liquid and vapor from the evaporator and in which the liquid refrigerant is retained while the refrigerant vapor is returned to the compressor.

Another object of the invention is to provide a process for delivering liquid refrigerant to an evaporator substantially at a predetermined pressure and substantially at evaporator temperature while simultaneously receiving refrigerant liquid and vapor from the evaporator and separating the refrigerant liquid from the vapor.

DESCRIPTION OF THE PREFERRED EMBODIMENTS

Figure 1:
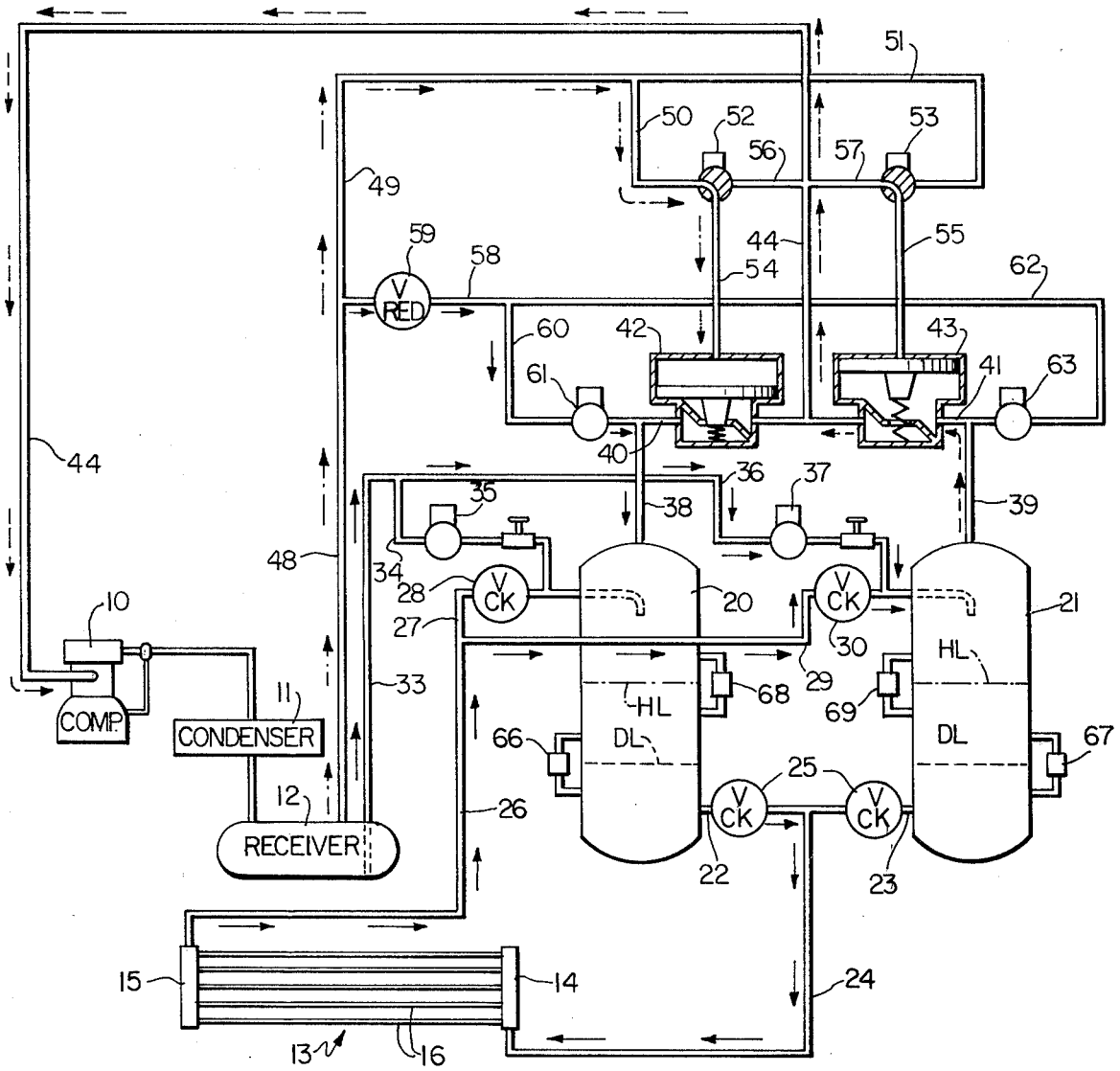
FIG. 1 is a schematic of a refrigerating system in which a first tank has been pressurized for pumping liquid refrigerant to the evaporator while a second tank is separating refrigerant liquid and vapor discharged from the evaporator.

With continued reference to the drawings, a refrigeration system which may be used for relatively large structures such as ice rinks and the like, ordinarily includes a compressor 10, condenser 11 and receiver 12 connected together in a conventional manner. An evaporator 13 is provided, which usually is of the flooded type, and includes inlet and outlet headers 14 and 15, respectively, connected by a plurality of pipes 16.

In order to supply the evaporator with refrigerant liquid substantially at evaporator temperature, a pair of pumping tanks 20 and 21 are provided which are adapted to be operated in timed relationship with each other so that one of the tanks may be pressurized to a predetermined pressure to deliver liquid refrigerant to the evaporator, while the other pumping tank is receiving refrigerant liquid and vapor from the evaporator substantially at evaporator pressure. The pumping tanks 20 and 21 are connected by discharge lines 22 and 23, respectively, to a main supply line 24 which is connected to the inlet header 14 of the evaporator. Each of the discharge lines 22 and 23 is provided with an inline check valve 25 which permits liquid refrigerant to flow only in the direction away from the associated pumping tank.

Liquid refrigerant flows from the inlet header 14 through the pipes 16 to the outlet header 15 and during the flow through such pipes some of the liquid refrigerant converts to a vaporous state while absorbing heat from the area surrounding the pipes 16 so that the outlet header 15 receives a mixture of refrigerant liquid and vapor. A main evaporator discharge line 26 is connected to the outlet header 15 and such evaporator discharge line has a first branch line 27 which extends through a check valve 28 into the pumping tank 20, and a second branch line 29 which extends through a check valve 30 into the pumping tank 21.

One of the pumping tanks 20 or 21 is adapted to be pressurized to cause liquid refrigerant at evaporator temperature to flow from such tank into the evaporator 13, while the other pumping tank is receiving refrigerant liquid and vapor from the evaporator at evaporator pressure and such tanks are operated in timed sequence in a manner which will be described later. The pumping tank which is receiving liquid and vapor from evaporator separates the refrigerant liquid from the refrigerant vapor and holds the refrigerant liquid for recirculating to the evaporator, while the vapor is returned to the compressor.

In order to supply makeup refrigerant liquid for the refrigerant which has evaporated, a liquid makeup line 33 is provided having an inlet end located adjacent to the bottom of the receiver 12 where it is disposed below the liquid level in the receiver at all times. The liquid makeup line 33 has a first branch line 34 which passes through a normally closed selenoid operated control valve 35 and is connected to the brach line 27 between the check valve 28 and the pumping tank 20. A second branch line 36 passes through a normally closed solenoid operated control valve 37 and is connected to the branch line 29 between the check valve 30 and the pumping tank 21.

The upper portion of each of the pumping tanks 20 and 21 is provided with a pressure-suction line 38 and 39, respectively. The pressure-suction lines 38 and 39 communicate with branch lines 40 and 41, respectively, each of which passes through normally open pressure operated control valves 42 and 43 to a main suction line 44 which leads to the compressor 10.

In order to selectively and alternately pressurize the pumping tanks 20 and 21, a high pressure line 48 communicates with the upper portion of the receiver 12 and receives vapor therefrom at condenser and receiver pressure. The high pressure line 48 has a first branch line 49 which supplies high pressure vapor from the receiver to a pair of sub-branch lines 50 and 51 which communicate with normally open solenoid operated three-way valves 52 and 53, respectively. High pressure lines 54 and 55 provide communication between the three-way valves 52 and 53 and the pressure operated control valves 42 and 43. Such three-way valves have suction lines 56 and 57, respectively, providing communication with the main suction line 44.

Each of the three-way valves is provided with a rotatable core having an opening therethrough which normally provides communication between the high pressure line 54 and the suction line 56 or the high pressure line 55 and the suction line 57. When desired, the core of the three-way valve 52 may be rotated to provide communication between the sub-branch line 50 and the high pressure line 54, or the three-way valve 53 may be rotated to provide communication between the sub-branch line 51 and the high pressure line 55. Communication between the sub-branch line 50 and the high pressure line 54, or between the sub-branch line 51 and the high pressure line 55, causes high pressure fluid to be introduced into the associated pressure operated control valve 42 or 43 and interrupt the flow of vapor through the associated branch line 40 or 41 to the main suction line 44.

The high pressure line 48 communicates with a second branch line 58 having a pressure reducing member 59 therein. On the down stream side of the pressure reducing member 59, the branch line 58 communicates with a first sub-branch line 60 which passes through a normally closed solenoid operated control valve 61 to the pressure-suction line 38 of the pumping tank 20, and a second sub-branch line 62 which passes through a normally closed solenoid operated control valve 63 and communicates with the pressure-suction line 39 of the pumping tank 21. The pressure reducing valve 59 may be adjustable so as to provide any desired pressure to the tanks 20 and 21 which is less than the condenser pressure in the receiver 12 but greater than the pressure in the evaporator 13. Also the system, including the pressure reducing valve 59 and the pumping tanks 20 and 21, may be sized and timed for any load at any temperature level and at any recirculation rate in accordance with the requirements of an individual system.

The pumping tanks 20 and 21 are provided with normally closed liquid level cutoff switches 66 and 67, respectively, which define a design liquid level DL indicated by a dotted line in each tank. When the design liquid level is reached, switches 66 and 67 open to deactivate the solenoid operated valves 35 and 37, respectively, to interrupt the flow of makeup liquid refrigerant into the tank being filled. However, at this time the discharge of liquid and vapor from the evaporator 13 must continue and it is therefore possible for the liquid level in the tank being filled to continue to rise. In order to prevent the liquid level from rising to an unsafe level, a normally open high level cutoff switch 68 and 69 is provided for each of the tanks 20 and 21, respectively. The cutoff switches 68 and 69 define a high liquid level HL indicated by a dot-dash line in each of the tanks 20 and 21. Operation by either of the high level cutoff switches activates a timer 70 (FIG. 4) which stops the compressor 10 after a preset time.

Figure 3:
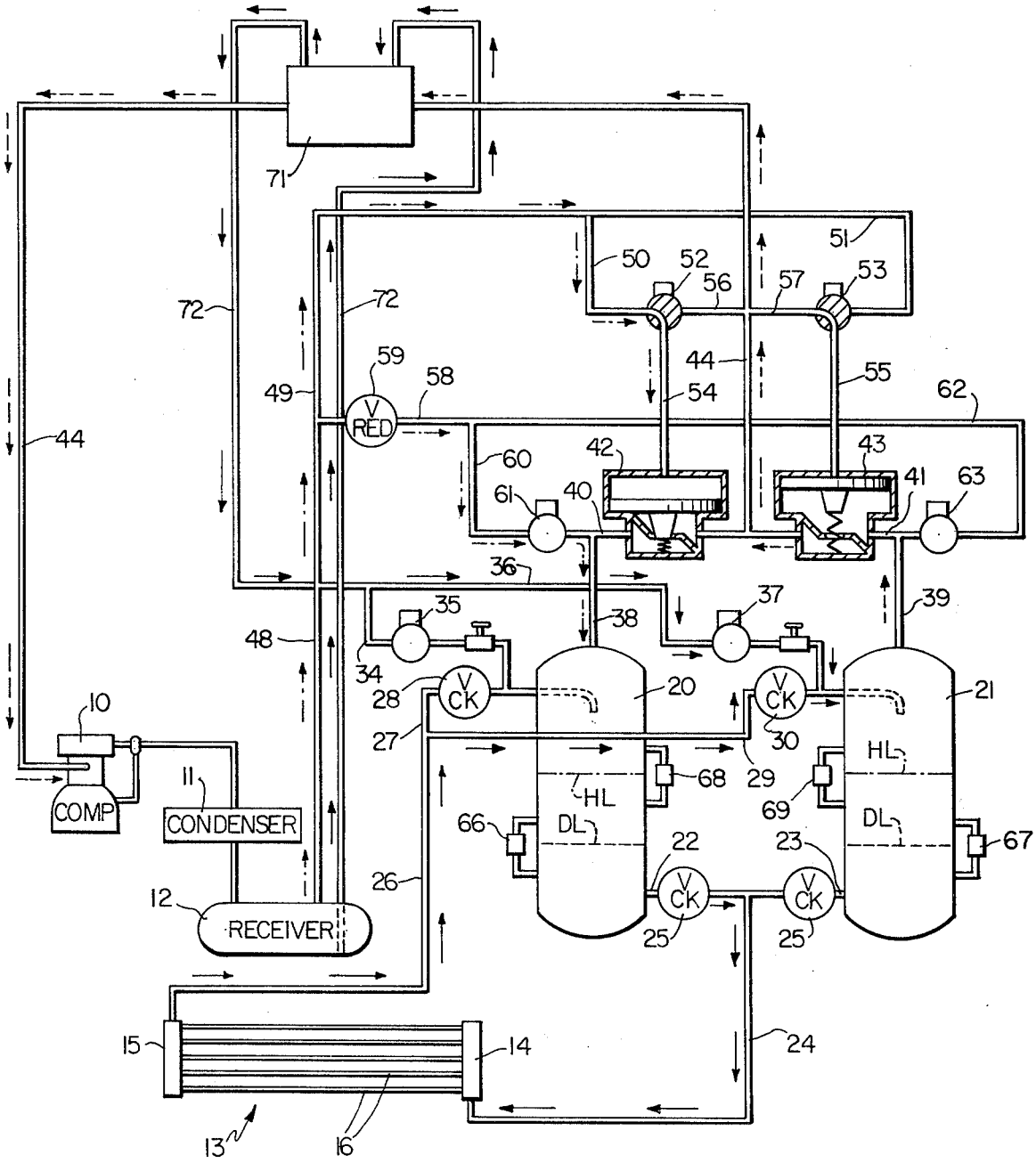
FIG. 3 is a schematic similar to FIG. 1 illustrating another embodiment of the invention and including a heat exchanger in the suction line.

With particular reference to FIG. 3, separation tanks such as 20 and 21 may, with certain refrigerants and high loading on pulldown, permit some liquid mist entrainment to remain in the vapors entering the return line 44. To evaporate such mist entrainment and to obtain beneficial liquid subcooling from said evaporation, a suction line heat exchanger 71 is provided which is associated with the suction line 44. In this embodiment, instead of the main liquid makeup line 33, which supplies liquid refrigerant to the branch lines 34 and 36, a main liquid makeup line 72 passes through the heat exchanger and supplies liquid refrigerant to the branch lines 34 and 36. The heat exchange in the exchanger 71 is between liquid refrigerant at condensing temperature and suction line vapor at a temperature of 0° to 15° above the evaporator temperature.

Figure 4:
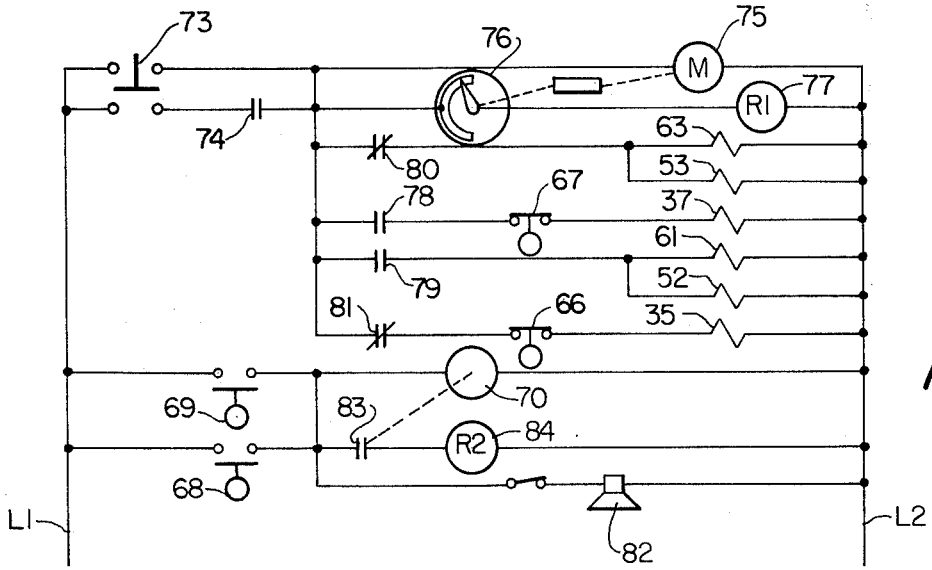
FIG. 4 is a schematic wiring diagram of the apparatus.

With particular reference to FIG. 4, a specific wiring diagram is illustrated which has proved satisfactory for controlling the apparatus and includes a pair of electrical conductors L1 and L2 which are connected to a source of electrical energy. A three-position switch 73 is provided for establishing or interrupting the flow of energy to the component parts of the system. In a first position the switch 73 is in a neutral or off position; in a second position the system is energized for manual operation; and in a third position the system is energized for automatic operation. A normally open compressor interlock switch 74 is provided in the automatic system and such switch is closed only when the compressor is in operation.

When the three-position switch 73 is moved to either manual or automatic operation, electrical energy is supplied to a program motor 75 which drives a make-or-break device 76. The make and break phases are substantially equal in time and during the make phase a relay 77 is energized so that relay contacts 78 and 79 are opened and relay contacts 80 and 81 are closed. During the break phase the flow of energy to the relay 77 is interrupted so that contacts 78 and 79 are closed and the contacts 80 and 81 are open.

During most of the time of operation of the apparatus, the tanks 20 and 21 are alternately pressurized and open to suction by the program motor 73 so that the liquid level within the tanks seldom reaches the high liquid level HL. The high liquid cutoff switches 68 and 69 are normally open so that no electrical energy flows to the timer 70. However, if the liquid level in either of the tanks should rise to the high liquid level HL, the corresponding high level cutoff switch closes to activate the timer 70 and simultaneously energize a signal 82 which may be a light, horn, bell or other alarm. After a preset time the timer 70 closes a switch 83 to energize a relay 84 which stops the compressor 10. The relay 84 is a safety device which has a normally closed contact in the compressor safety cutout line.

In the operation of the device, with particular reference to FIG. 1, the tank 20 is in a pressurized condition to discharge liquid refrigerant from such tank in the direction of the solid arrows through the discharge line 22 and main supply line 24 to the evaporator 13. In order to pressurize the tank 20, refrigerant vapor under condenser pressure passes through the high pressure line 48, as indicated by the dot-dash arrows, and through the branch line 49, sub-branch line 50, three-way valve 52, and high pressure line 54 to operate the high pressure control valve 42 to close the suction branch line 40. Simultaneously high pressure vapor passes through the branch line 58 to the pressure reducing member 59, where the pressure is reduced to a level less than condenser pressure but greater than evaporator pressure, and passes through the sub-branch line 60, control valve 61 and pressure-suction line 38 into the tank 20.

Figure 2:
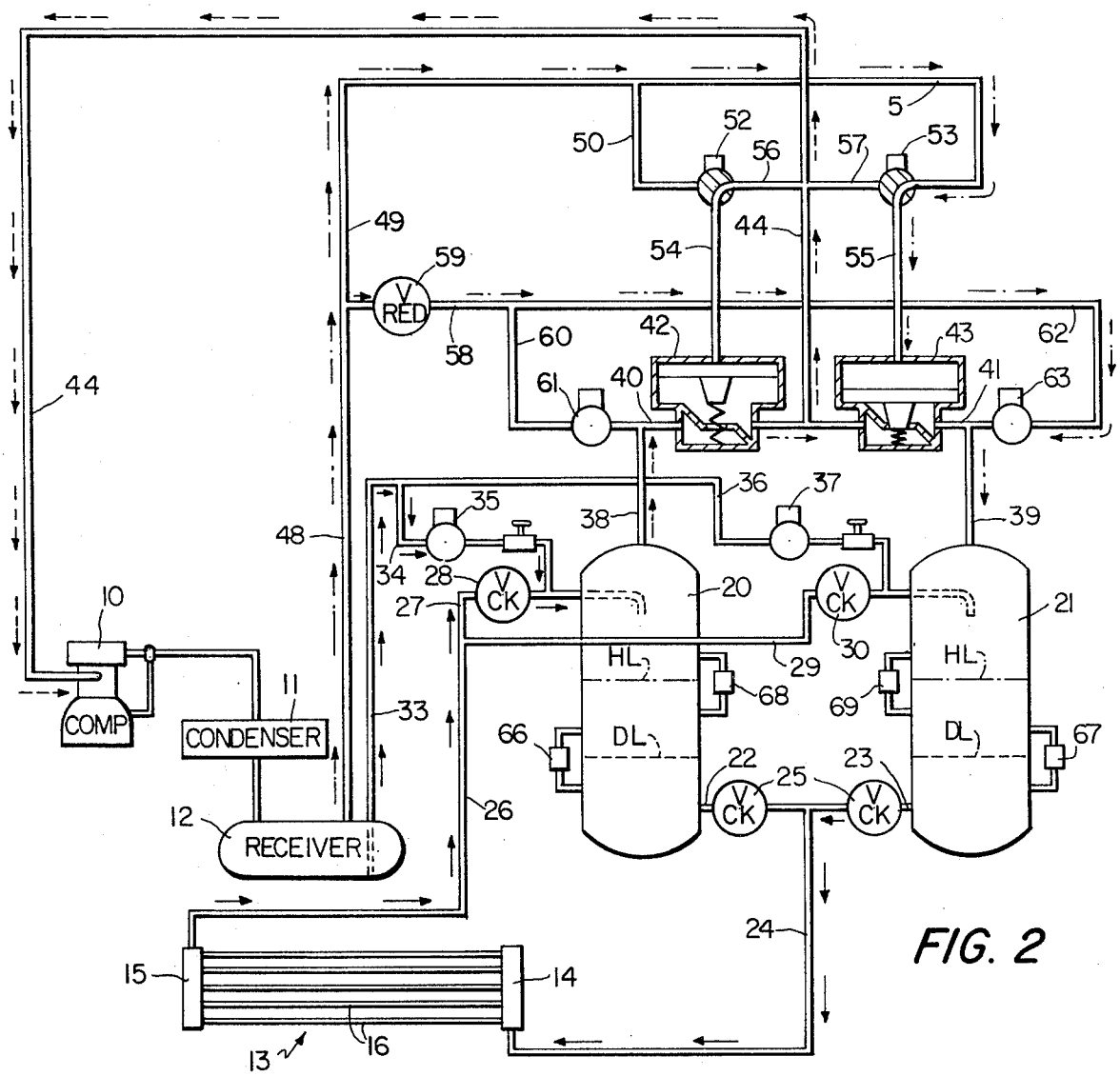
FIG. 2 is a schematic similar to FIG. 1 illustrating the arrangement when the first tank is receiving refrigerant from the evaporator while the second tank is pumping refrigerant into the evaporator.

At the same time liquid and vapor at evaporator pressure are discharged from the evaporator along the discharge line 26, branch line 29, and check valve 30 into the tank 21. At this time the high pressure within the tank 20 has closed check valve 28 so that the branch line 27 is closed. While the discharge from the evaporator is flowing into the tank 21, makeup liquid from the receiver 12 flows through the liquid makeup line 33, branch line 36, and control valve 37 into the branch line 29 where it is discharged into the tank 21. When the liquid level within the tank 21 rises to the design liquid level DL, the liquid level cutoff switch 67 interrupts the flow of electricity to the solenoid operated control valve 37 which then closes and stops the introduction of makeup liquid into the tank 21. Within the tank 21, the liquid refrigerant, which is at evaporator pressure, remains within the tank while the vapor which was discharged from the evaporator 13 is drawn out of the tank by suction from the compressor 10 through the pressure-suction line 39, branch line 41, control valve 43, and main suction line 44 along the path indicated by the dotted arrows to the compressor. This operation continues until the program motor 75 moves the make-or-break device 76 to its second phase at which time the operation of the tanks 20 and 21 is reversed so that the tank 21 is pressurized to discharge liquid refrigerant into the evaporator 13, and the tank 20 is opened to suction so that refrigerant liquid and vapor from the evaporator are discharged into the same together with makeup liquid. This phase of operation is illustrated in FIG. 2.

I claim:

1. In a refrigeration system having a compressor, condenser, receiver and evaporator, the improvement comprising a pair of pumping tank means, said tank means alternately receiving refrigerant liquid and vapor from said evaporator at evaporator pressure, means for discharging refrigerant vapor from said tank means to said compressor, means for alternately pressurizing said tank means for discharging refrigerant liquid at evaporator temperature from said tanks to said evaporator, said pressurizing means receiving vapor under condenser pressure from said receiver, and means for reducing the pressure of the pressurizing vapor to a level less than condenser pressure but greater than evaporator pressure.

2. The structure of claim 1 in which said means for alternately pressurizing said tank means includes a timing mechanism.

3. The structure of claim 1 including means for introducing makeup refrigerant liquid into said tank means.

4. The structure of claim 3 including means for controlling the amount of makeup liquid which is introduced into said tank means.

5. The structure of claim 1 including means to deactivate said compressor when liquid in either of said tank means reaches a predetermined liquid level.

6. The structure of claim 1 including heat exchange means associated with said means for discharging refrigerant vapor.

7. A dual liquid delivery and separation apparatus for use with a refrigeration system having a compressor, condenser, receiver, and evaporator comprising a pair of pumping tanks, a supply line connecting said tanks to said evaporator for introducing liquid refrigerant into said evaporator, a discharge line connecting said evaporator to each of said tanks for discharging refrigerant liquid and vapor from said evaporator alternately into said tanks, means for discharging refrigerant vapor from said tanks to said compressor, means for alternately pressurizing said tanks for causing refrigerant liquid from said tanks to flow through said supply line to said evaporator, said means for pressurizing said tanks including a high pressure line connected to said receiver for receiving refrigerant vapor at condenser pressure therefrom, vapor pressure reducing means connected to said high pressure line for reducing the pressure to a level which is less than condenser pressure but greater than evaporator pressure, and timing means for controlling the operation of said apparatus, whereby said tanks are alternately pressurized to supply liquid refrigerant to said evaporator and are opened to suction so that they function as a separator for refrigerant liquid and vapor at evaporator pressure.

8. In a refrigeration system having a compressor, condenser, receiver and evaporator, the method of separating and delivering liquid refrigerant at evaporator temperature to the evaporator from a pair of alternately pressurizable pumping tank means comprising the steps of: pressurizing a selected first tank means having liquid refrigerant therein at a pressure greater than evaporator pressure but less than condenser pressure, discharging refrigerant liquid and vapor from the evaporator into the non-pressurized second tank means, discharging refrigerant vapor from said second tank means while retaining refrigerant liquid at evaporator temperature and pressure, adding makeup refrigerant liquid from the receiver to said second tank means, and reversing the operation of said first and second tank means.

9. The method of claim 8 including the step of timing the operation of said first and second tank means.

* * * * *